United States Patent [19]

Carroll et al.

[11] Patent Number: 4,598,569

[45] Date of Patent: Jul. 8, 1986

[54] METHOD AND APPARATUS FOR MAKING GRAIN BIN FLOORING

[75] Inventors: Michael W. Carroll, Roselle; Michael E. Harwood, Palatine, both of Ill.

[73] Assignee: North American Agricultural, Inc., Schaumburg, Ill.

[21] Appl. No.: 637,410

[22] Filed: Aug. 3, 1984

[51] Int. Cl.[4] ..... B21D 13/02

[52] U.S. Cl. ..... 72/325; 29/6.2; 29/163.5 R; 72/385; 72/414

[58] Field of Search ..... 72/325, 338, 339, 385, 72/414, 324; 29/6.2, 163.5 R

[56] References Cited

U.S. PATENT DOCUMENTS

| | | | |
|---|---|---|---|
| 2,289,150 | 7/1942 | Tangerman | 72/414 |
| 3,430,476 | 3/1969 | Duda | 72/385 |
| 4,073,110 | 2/1978 | Kennedy . | |
| 4,194,277 | 3/1980 | Rubinshtein et al. | 72/414 |
| 4,418,558 | 12/1983 | Simmons . | |
| 4,502,315 | 3/1985 | Dubrovsky et al. | 72/385 |

*Primary Examiner*—W. D. Bray

*Attorney, Agent, or Firm*—Fitch, Even, Tabin & Flannery

[57] ABSTRACT

Corrugated grain bin floor plates are manufactured from a continuous flat metal strip by a progressive die set in a punch press. The metal strip is fed into a slitting section of the die set to form slits in the sheet extending in the longitudinal direction of the strip. The strip is then fed to a corrugating section of the die set where the sheet is corrugated with the corrugations running longitudinally of the strip. The metal along the slits is stretched and reformed to form openings covered by an upper hood to prevent grain from falling through the openings. The openings are located at a neutral axis for the corrugations. The bending and drawing of the metal in the strip provides an increase in the strength of the grain floor plates. The floor plates are severed from the strip at the end of the die set.

11 Claims, 16 Drawing Figures

METHOD AND APPARATUS FOR MAKING GRAIN BIN FLOORING

This invention relates to a method and apparatus for making aerated grain bin flooring from sheet metal strips or sheets.

BACKGROUND OF THE INVENTION

The present invention is particularly adapted for making grain bin storage sheets or flooring of the type shown in copending application Ser. No. 573,969, filed Jan. 26, 1984 which is hereby incorporated by reference as if fully reproduced herein. In the aforesaid patent application there is disclosed a novel grain bin flooring which is formed from a series of corrugated plates having hooded openings in the plates through which air is blown from a blower. In grain bins of this type, the floor plates are relatively large, as disclosed in the aforesaid application, being approximately 3 feet×7 feet in size.

Other grain bin flooring plates such as disclosed in U.S. Pat. No. 4,073,110 are relatively narrow in that they are only approximately 7 inches in width and may extend to 30 or 40 feet in length. Such prior art grain bin flooring plates are formed with a male channel and a female channel along their respective longitudinally extending edges so that the male channel of one floor plate may be fitted into and interlocked with the channel of an adjacent plate. A method of manufacture of said sheets is shown in U.S. Pat. No. 4,418,558 which discloses the formation of the corrugations extending in a transverse direction to the longitudinal length of the flooring plates and with the slits being elongated in this transverse direction. U.S. Pat. No. 4,418,558 discloses a series of roll forming machines by which the plates are formed with the transverse corrugations and the transversely extending slits. Also, in this patent there is disclosed the method of forming the male and female channels at the time of forming of the transversely extending corrugations.

Typically, grain metal flooring plates are made of galvanized sheet metal which often is formed into a corrugated shape. The loads on the corrugated sheet metal are very substantial so that strength is an important consideration in the formation of the plates. In some instances heretofore, the plates were actually perforated with metal removal to form the aeration openings with as much as 10% of the metal being removed from the sheet. Such loss of metal has a deleterious effect on the ultimate strength of the plate. As will be explained in greater detail hereinafter, the present invention not only does not remove metal from the plate but shifts the metal upwardly and downwardly to with the openings being located at the neutral axis of the corrugations. Additionally, the plates of the present invention undergo slitting, bending and drawing which causes grain flow and cold working and increases hardness of the metal. The result has been found to significantly increase the yield strength due to cold working from for example about 45,000 psi to 55,000 psi yield.

Rather than using roll forming machines as in the aforementioned patent, the present invention is directed to the use, in this preferred embodiment, of a progressive die set which processes finished sheets as fast as the perforating or slitting operation without the use of secondary operations such as corrugating in a different machine which would involve material handling and a reduction in the efficiency of the operation.

Accordingly, an object of the present invention is to provide a new and improved method of and apparatus for making grain bin flooring plates.

These and other objects and advantages of the present invention will become apparent from the following detailed description taken in connection with the accompanying drawings in which.

Figure 1:
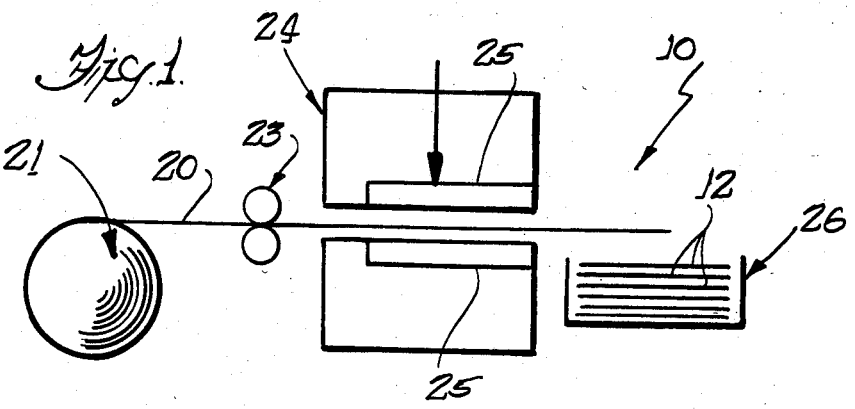
FIG. 1 is a diagrammmatic view of an apparatus constructed in accordance with the preferred embodiment of the invention.

As shown the drawings for purposes of illustration, the invention is embodied in an apparatus 10 (FIG. 1) and a method for making corrugated floor plates 12 which have a plurality of ribs or corrugations 13 extending in the longitudinal direction with a plurality of slots or aeration openings 15 formed in sloping side walls 16 of the corrugations. The particular plates 12 illustrated herein are formed from galvanized sheet metal having a thickness of about 0.038 inches. Of course, the thickness of the particular floor plate may vary substantially.

The preferred and illustrated floor plates 12 may be approximately 3 feet in width from one longitudinal edge 18 to opposite longitudinal extending edge 19 and the sheets extend approximately 7 feet in the direction of the corrugation. Of course, the size of the plate may be changed and still fall within the purview of the present invention.

The present invention is directed to providing floor plates in a very economical manner which avoids some of the shortcomings of prior art methods, such as the actual removal of 10% of the metal to form the openings which loss of metal considerably weaken the sheets. Indeed as will be explained hereinafter the actual tensile strength and the ability to handle loads is increased by metal movement as contrasted to the weakening of sheets in many prior art floor plates which had the metal removed therefrom. Also, the present invention is directed to formation of unique openings or perforations 15 in the sheets at precise locations at a neutral axis 33 (FIG. 4) for the plate 15, as will be explained in greater detail hereinafter.

In accordance with the present invention a metallic strip of metal 20, as best seen in FIG. 1, may be unrolled from a sheet metal roll 21 and fed by a feed means 23 to a punch press 24 which has progressive die set 25 which operates to form the corrugations 14 and the openings 15 in the strip in a continuous manner until the strip is severed and then the resultant plates 12 are automatically stacked within a stacking mechanism 26. In the preferred embodiment of the invention, the strip 20 is fed from the roll 21 in an intermittent manner by feed rolls 23 into the punch press 24 with short feed increments for a large number of times per minute, with the slitting operation being formed at each punch press operation and with the corrugations being formed by successive metal deformations in the die set. During the corrugating, the metal about the slits is bent to form the upper and lower hoods 70 and 71 (FIG. 4) which are also described in the aforementioned patent application.

In accordance with an important aspect of the present invention, the actual tensile strength of the particular floor plates is increased substantially during the cold working of the metal strip; for example the tensile strength may be increased from a range of about 45,000 to 55,000 psi yield due to cold working which involves the reverse bending and drawing of the sheet metal. Further, the metal is coined as it is formed into final precise corrugated shape, as will be explained in greater detail.

Figure 3:
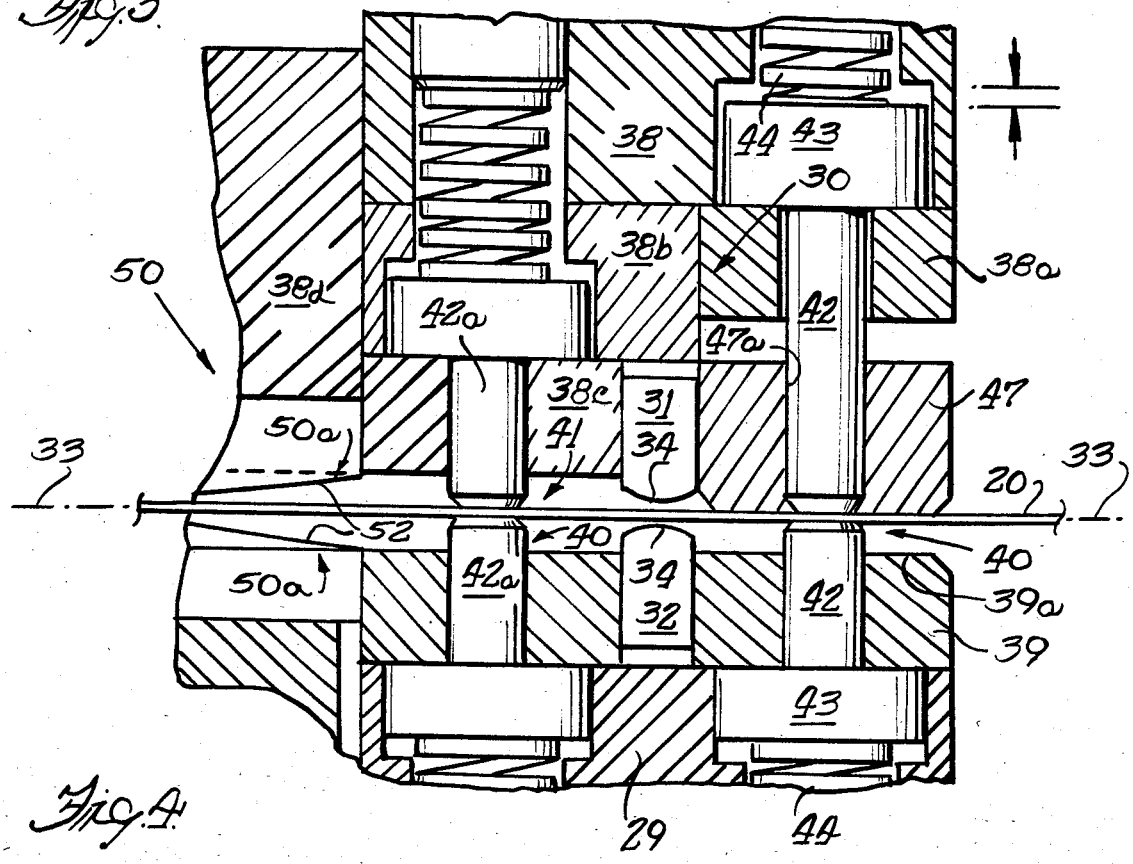
FIG. 3 is a partial sectional, view through a slitting section of the slitting die.
Figure 6:
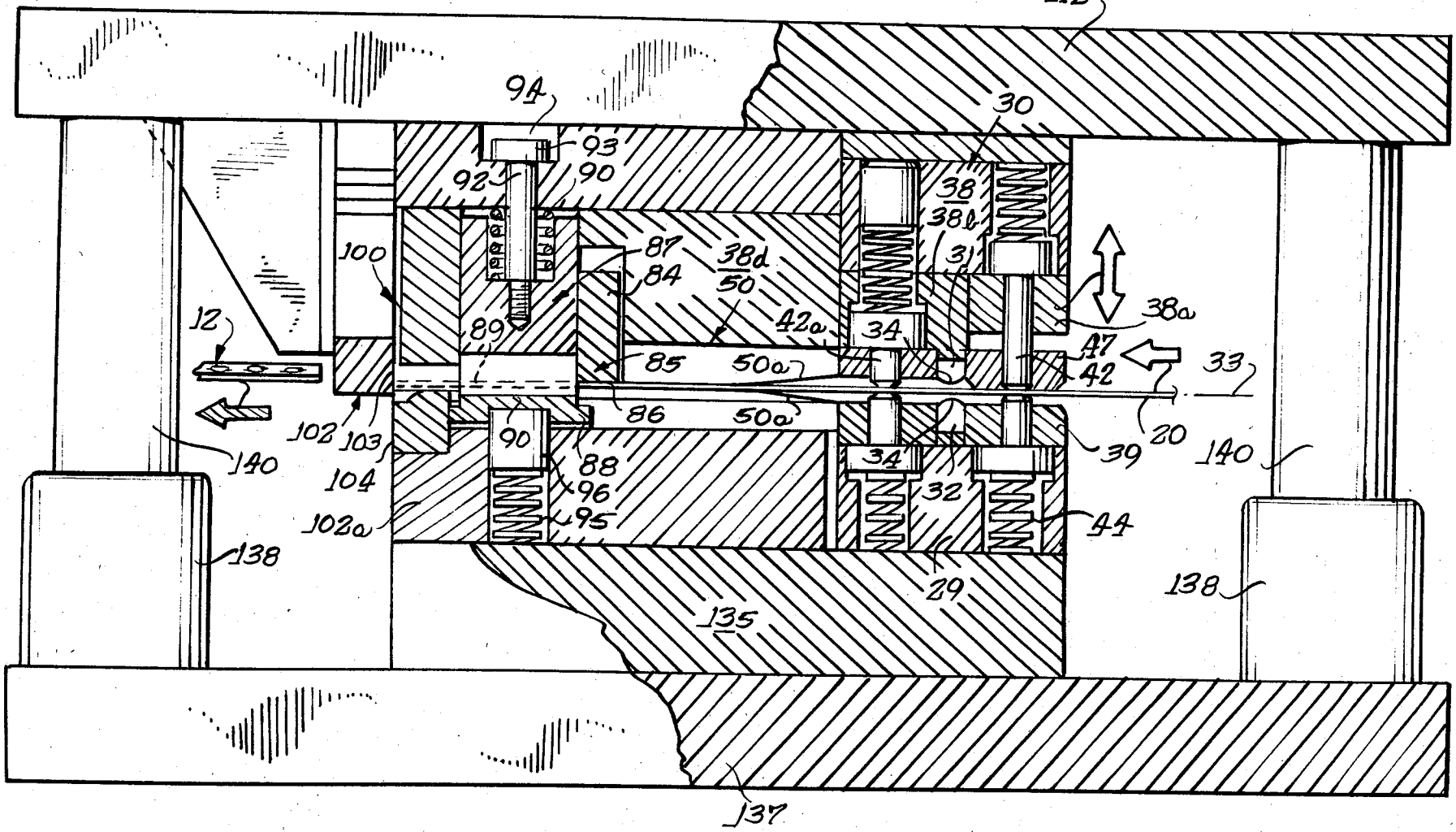
FIG. 6 is a cross-sectional view showing the progressive die set.
Figure 6A:
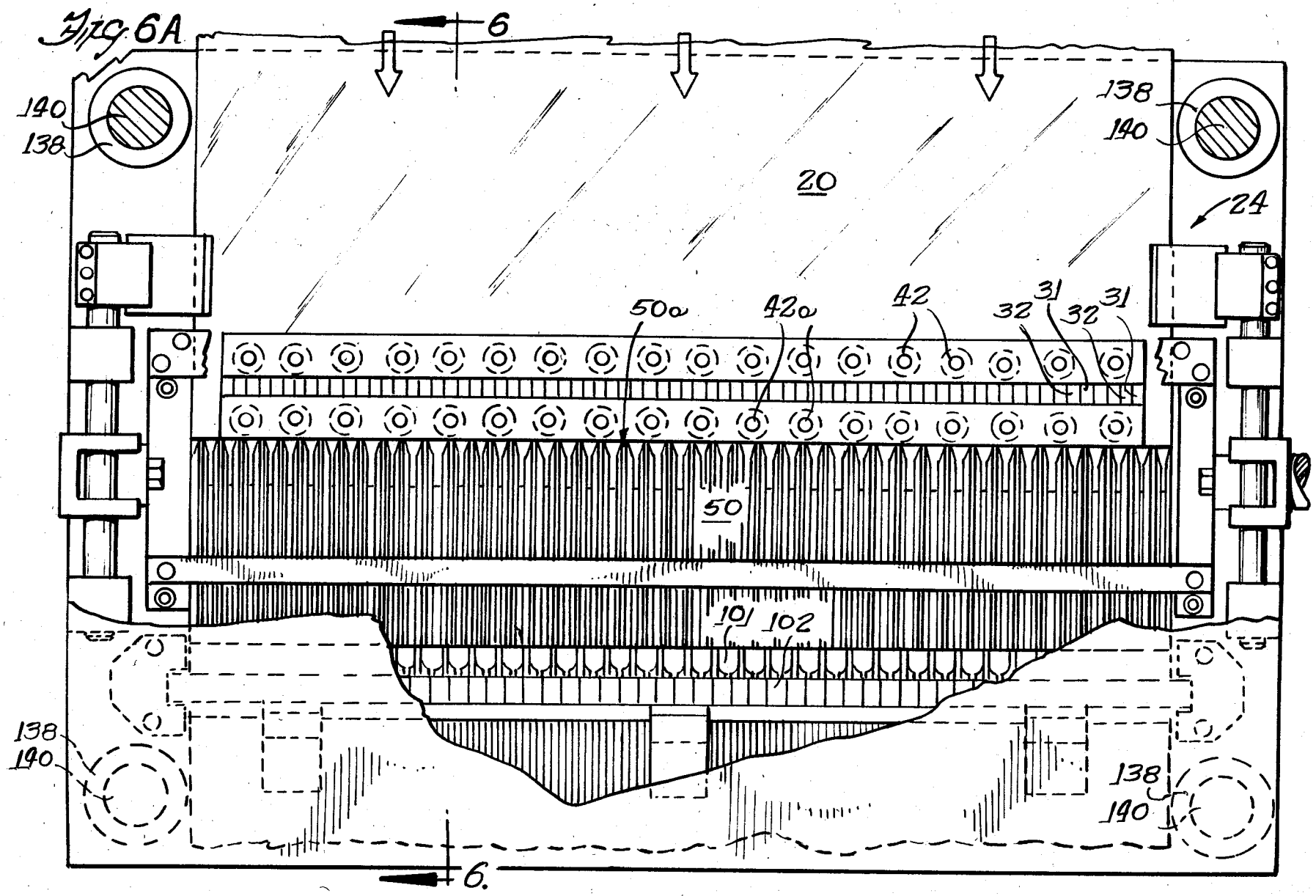
FIG. 6A is a partial plan view of the punch press and die set.

Referring now in greater detail to the preferred apparatus, as will be described generally in connection with FIG. 6, the metal strip 20 is fed from right to left into a first section 30 of the die set 25 at which are located upper and lower slitter dies 31 and 32 which operate to slit the sheet metal. The respective slitter dies 31 and 32 each have a rounded nose or point 34 which pushes against the metal and forces the metal upwardly and downwardly respectively to form bent and rounded configuration on opposite sides of the slits. As best seen in FIG. 6A, the upper and lower slitter dies 31 and 32 are arranged in a transverse row across the die with the metal being slit between adjacent edges of the slitter dies. As best seen in FIGS. 3 and 6, each of the upper and lower sitter dies 31 and 32 are spaced from each other and from the sheet or strip 20 when the die is open with the strip being positioned on a pass line 33 which is a theoretical line through the center of the strip. The respective upper and lower slitter dies 31 and 32 force the metal in opposite directions for about ⅛ inch with the slit metal having the rounded configuration of the respective noses 34 shown in FIG. 3. The upper slitter dies 31 are mounted in an upper die block 38 and the lower slitter dies 32 are mounted in a lower die block 39.

Spring bias strippers 40 and 41 are disposed of opposite sides of the strip 20 and, in this instance, include an initial set of cylindrical upper and lower stripper pins 42 which have enlarged heads 43 against which are abutted springs 44 to push the stripper pins downwardly and upwardly, respectively, and toward each other and toward the strip. A similar set of stripper pins **42*a* is located immediately inwardly of the slitter dies 31 and 32**.

A fixed stripper block 47 (FIG. 3) serves to limit the upperward movement of the strip 20 after slitting. The stripper block 47 is a stationary piece of the punch press while the upper die block pieces 38, **38*a*, 38*b*, 38*c* and 38*d*, FIG. 3, all travel upwardly after the slitting operation through the full stroke which may, for example, be several inches. The actual working stroke is much smaller, for example, about ¼ inch. Thus, the stripper pins 42 will travel upwardly over one inch into the bores 47*a* in the stationary stripper block 43 and lift their lower ends from the strip 20 and likewise the lower ends of the stripper pins 42*a* will be lifted above the top surface of the strip. The strip is fed forwardly while the upper die is raised with the strip being held by lower stripper pins above the top surface 39*a*** of the lower die.

On the downward stroke of the punch press, the upper stripper pins **42*a* and 42 will again engage the strip 20 and will force the strip down to engage the noses 34 of the lower slitter dies 32. Unlike conventional punch presses, the opposed upper and lower springs 44 are all equal and balanced so that the strip may remain above the top surface 39*a* of the lower die block 39** during the slitting and corrugating operations. In most conventional presses, the upper stripper springs are significantly stronger than the lower stripper springs and these stronger upper springs usually force the sheet flat against the upper surface of the lower die block before slitting or punching. This was tried and found to be unsatisfactory as the finished corrugated strip was found to have a definite curl or bend in the upward direction rather than being a flat, uncurled strip as desired and now obtained with the present invention.

In essence, the balanced strippers 42, **42*a* act to hold the strip at a pass line 33 located between the upper and lower slitter dies 31 and 32 so that to the workpiece it appears as though the lower slitter dies 32** were actually moving upward into the strip. Because the strip is floating between the balanced stripper springs, it appears to the strip that both the upper and lower slitter dies are moving and forcing metal in opposite directions with similar balanced stresses being imparted to the strip. This balancing of the stresses eliminates the curling effect found when the sheet is held flat and stationary and all of the force comes from one direction.

Figure 7:
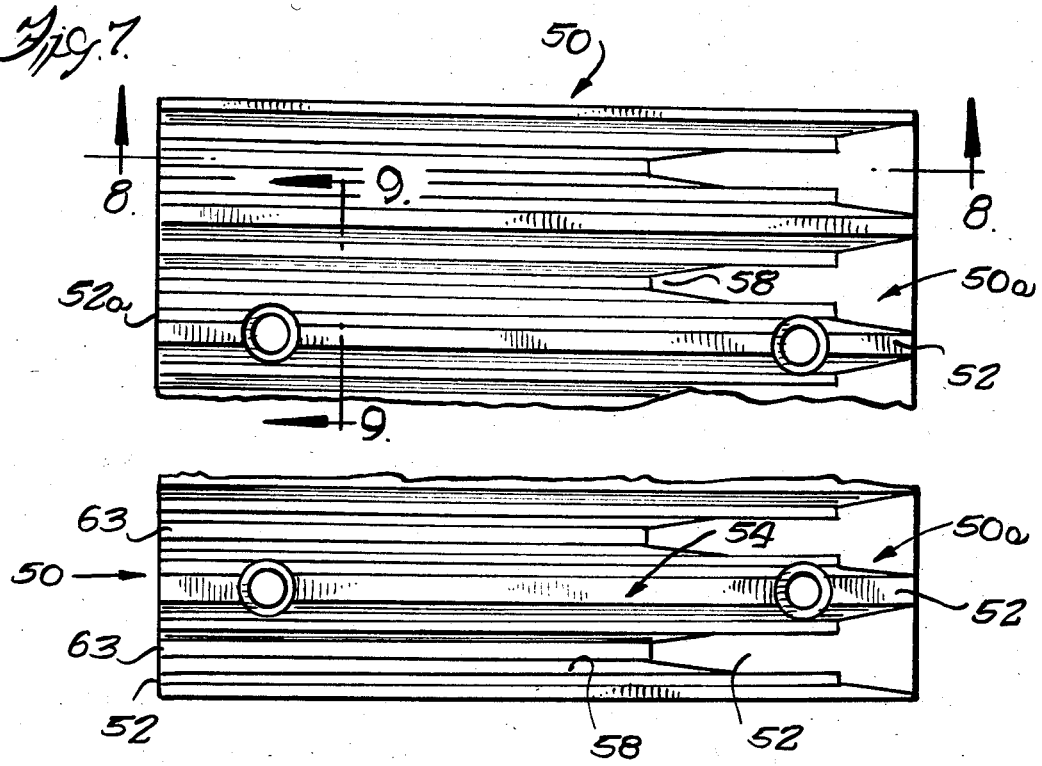
FIG. 7 is a plan view of a corrugating die.
Figure 8:
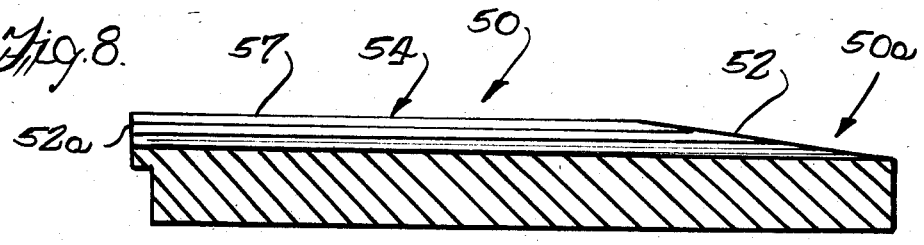
FIG. 8 is a longitudinal cross-sectional view taken substantially along the line 8—8 of FIG. 7.
Figure 9:
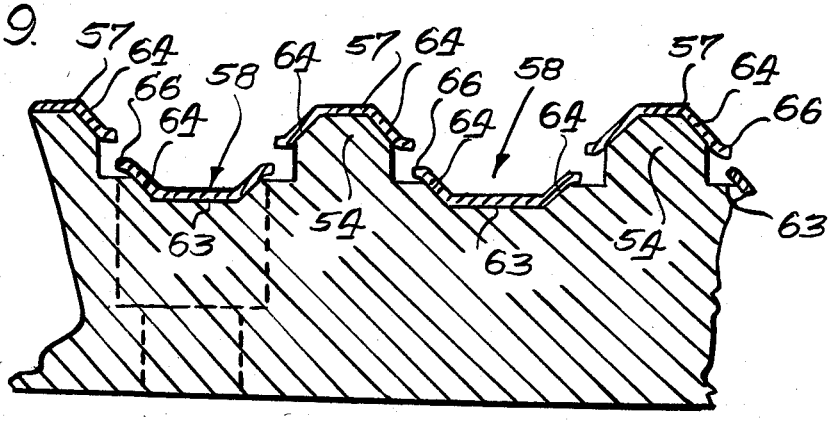
FIG. 9 is an enlarged cross-sectional view taken substantially along the line 9—9 of FIG. 8.
Figure 10:
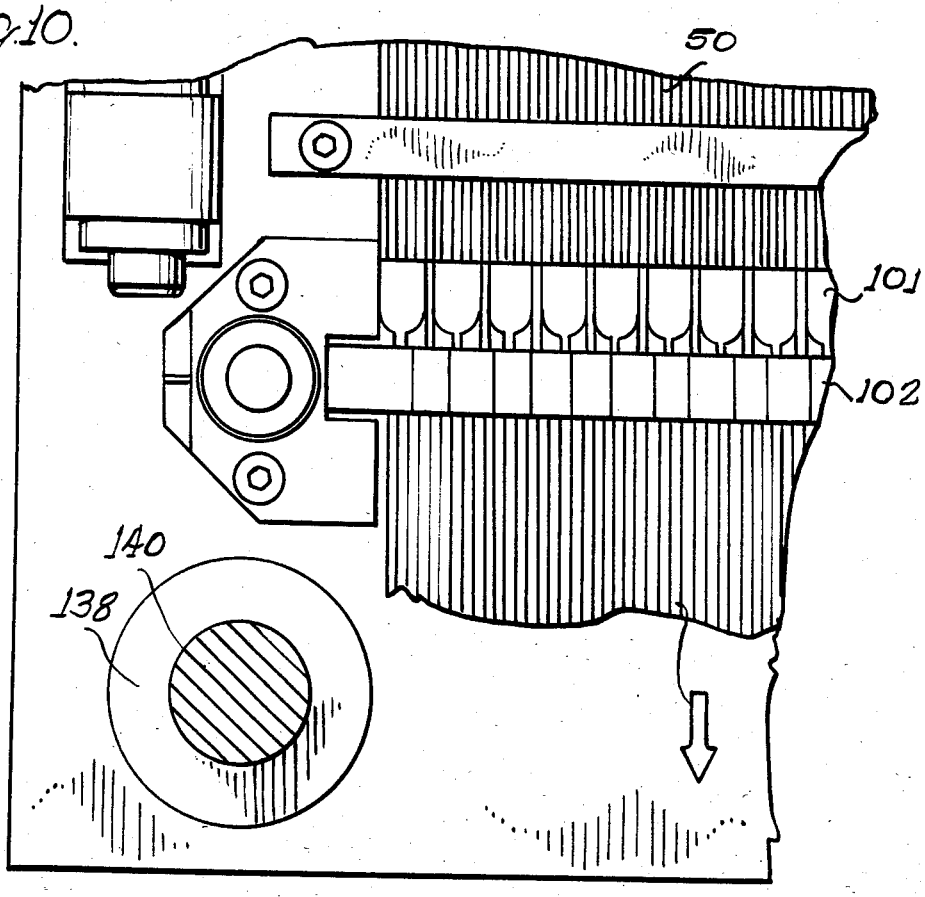
FIG. 10 is a partial plan view of the cutoff section of the die set.

The slit portion of the strip having a transverse row of slits extending entirely across the width of the strip enters into the corrugation forming die section 50, as best seen in FIGS. 3 and 6 which has upper and lower inclined lead-in ends **50*a*. These inclined lead-in sections 50*a* have inclined surfaces 52 at the right end thereof which provide a lesser sheet deformation than do the full die projections 54 (FIGS. 8 and 9). As best seen in FIGS. 7, 8 and 9, the corrugation forming die section 50 of the die set 25 includes a large number of grooves 58 spacing longitudinally extending die projections 54 which have generally flat upper walls 57 and a pair of sloping side walls 64 which are interrupted by recesses 66. The upper and lower respective die sections are each identical in shape and that the projection 54 of the lower die set shown in FIG. 8 projects into a similar groove 58 on the overhead die set. As best seen in FIG. 9, the top walls 57 are generally flat and horizontal as are bottom walls 63 that define the lower side of the grooves 58. The sloping side walls 64 are planar except for recesses 66** therein.

To assist in the formation of the hooded openings 15 and to prevent the hoods 70 (FIG. 4) from being deformed or brought together, the recesses or cutouts 66, as best seen in FIG. 8 are aligned with the hoods 70 which project into these recesses in the metal is stretched about the projections 54 and pushed against the bottom wall 63. It can be best understood with reference to FIG. 4 in which is shown a given length L of metal 69 which is stretched into the configuration shown with the curved upper apex 61 for the corrugation and a lower bottom curved wall 62. The stretching of the metal results in cold working of the metal which increases its strength and hardness.

An actual grain deformation occurs during this cold working which results in appreciable increase in tensile yield strength from approximately 45,000 psi to 55,000 psi, in this illustrated embodiment of the invention.

Figure 4:
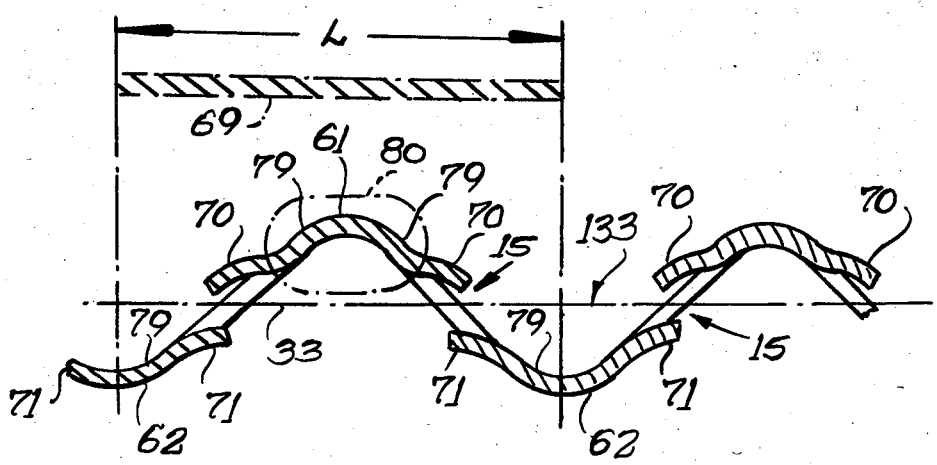
FIG. 4 is an enlarged cross-sectional view taken through a portion of the grain bin flooring plate made with the apparatus of FIG. 1.

Another important aspect of the particular corrugating operation is the actual opening up of the slits or opening 15 and the reconfiguring of the hoods 70 and 71 so that the upper hoods extend generally outwardly and over the aperature opening 72 and the lower hoods 71 extend inwardly. As mentioned in the foregoing patent application, the preferred size of the space of the opening is expanded from being a mere slit to about 0.03 to 0.06 inch as measured in the direction between edges as shown in FIG. 4. By way of example the slits extend in the longitudinal direction of the strip for about ⅜ths of an inch. Herein, the length L (FIG. 4) between corrugations is about ¾ of an inch with the corrugation height being a total of ¼ inch with each of the upper and lower die sets pushing the metal upwardly and downwardly about ⅛th of an inch from the pass line 33. Thus, it will be seen that the dies need not engage the metal at the hoods to form the same but that this metal naturally moves as the metal is drawn about the corrugating dies.

Figure 5:
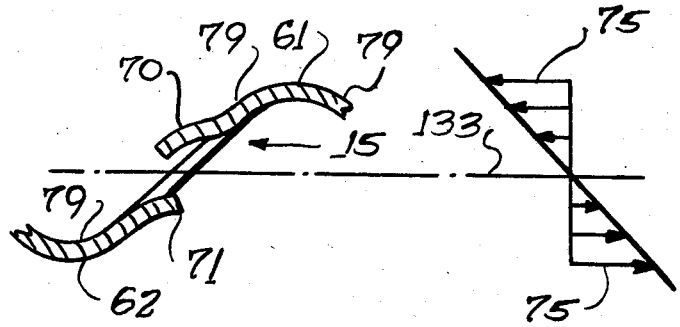
FIG. 5 is a diagrammatic illustration of a loading diagram for the floor plate.

In accordance with an important aspect of the invention, the openings are formed on a neutral axis 133, as best seen in FIG. 4, with the metal formerly at openings having been pushed upwardly and downwardly from the location of the center toward the apex 61 of the corrugation and toward the bottom 62 of the corrugation. A well known flexure diagram, which is a graphic representation of stress distribution in pure bending, is shown in the right hand portion of FIG. 5 to illustrate that the highest stresses are located at the top and bottom of the corrugated strip 20 when the strip is installed and loaded with grain. Thus, where the stresses are the lowest is at the center of the corrugated strip and this center of the strip is where the openings 15 are located to do the least damage to the strength of the floor in beam bending loading. The outward movement of the metal from the original slits at the neutral axis 133 locates metal fibers at the place where they are most needed to handle the flooring load from the grain thereon.

The preferred shape for the corrugated cross section as best seen in FIG. 4 includes rounded edges 79 leading into or coming out of apice or bottom so that the corrugated metal does not have sharp corners which could result in a potential failure point. The entire metallic area located within a circle shown as 80 in FIG. 4 is reworked particularly at the area about the openings 15 with the metal actually stretching and bending on the dies at the recesses 66 which allows the slits to open up. With the formation of the illustrated apex 61 and the bottom 62, the upper and lower hoods 70 and 71 are provided with an arched configuration to provide an overhanging eyebrow or projection which prevents grain from dropping straight through the opening 15 between the hoods 70 and 71.

Figure 2:
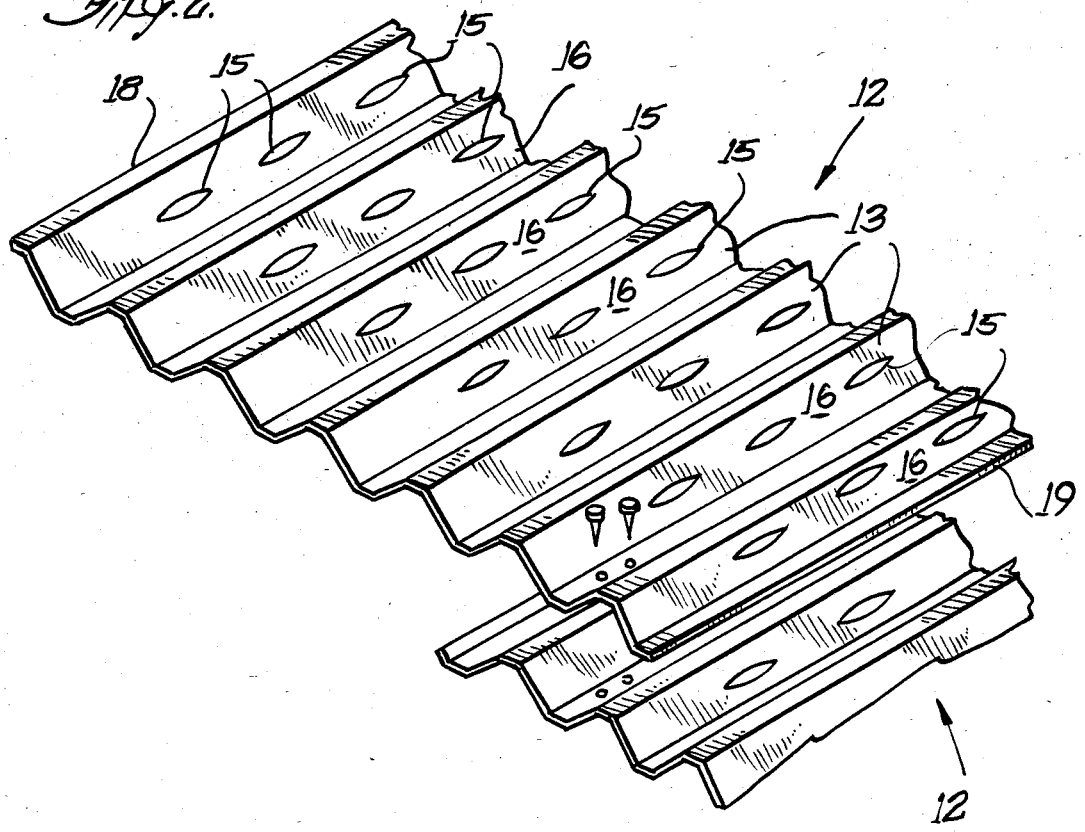
FIG. 2 is a diagrammatic perspective, fragmentary view of grain bin flooring plates made with the apparatus of FIG. 1.

As best seen in FIG. 2, each of the aeration openings 15 is aligned with another opening on the opposite sloping sides of its corrugation and the openings 15 are aligned in rows in the transverse direction. When viewed from directly above, relatively little space or opening is seen to the eye. Whereas when viewed in an angle in a perspective to the floor plate, one can readily see through the floor plate openings 15 which are about 10% the space of the floor area and one can see the underlying support structure. It is this openness which allows the air to flow through the grains as is desired, but which prevents the loss of grain or the cutting of grain.

By way of appreciation of the metal working undergone by the strip 20 during the corrugating operation, it is pointed out that the sheet feeds about ¾ of an inch in this illustrated die press with there being a large number of strokes per minute with a heavy punch press. The prepared die sections shown in FIGS. 7, 8 and 9 may be about 6 inches in length so that there are in excess of six seperate die engagements to complete the bending before the metal leaves the exit end 85 of the corrugating die section 50. The metal is progressively formed into a deeper and deeper corrugation on the sloping inlet section **50*a* until it is full formed and then receives several repeated blows while on the rearward section at which the metal is coined. That is, the repetitive blows on the corrugated metal make sure that the precise, shape of the dies is imparted into the strip and the metal is beat as in coining. Thus, the final uniformly shaped sheet has its openings precisely aligned in the transversion direction across the sheet and on both sides of the sloping plate walls 16**. With the upper hood being projected upwardly and the lower hood being projected downwardly, there is a substantial opening in the lateral direction through which the air may flow.

From the corrugating die section 50 (FIG. 6), the corrugated strip passes beneath a fixed upper stationary block 84 (FIG. 6) which has a lower end 86 abutted against the top of strip to act as a stationary stripper as in the manner of the fixed stripper block 47, FIG. 3. The corrugated strip then passes beneath a pair of spring bias strippers 87 and 88 which likewise have corrugated surfaces 89 and 90, respectively, which fit into the corrugations and prevent the strip from sliding in the lateral direction while the strip is being shifted in the longitudinal direction. That is the strippers 87 and 88 remain in sliding contact with the corrugations to prevent any lateral displacement of the strip so that stripping remains align. Herein, the upper stripper 87 includes a spring 90 which forces it downwardly and it is movable with the spring being encircled about a captured pin 92 having a head 93 in an enlarged space 94 so that the head may move upwardly. The lower stripper 88 includes a spring 95 pushing on a pin 96 to hold the stripper up against the underside of the corrugations. These upper and lower strippers are likewise balanced and of equal strength to maintain the strip along the neutral axis 33.

Figure 11:
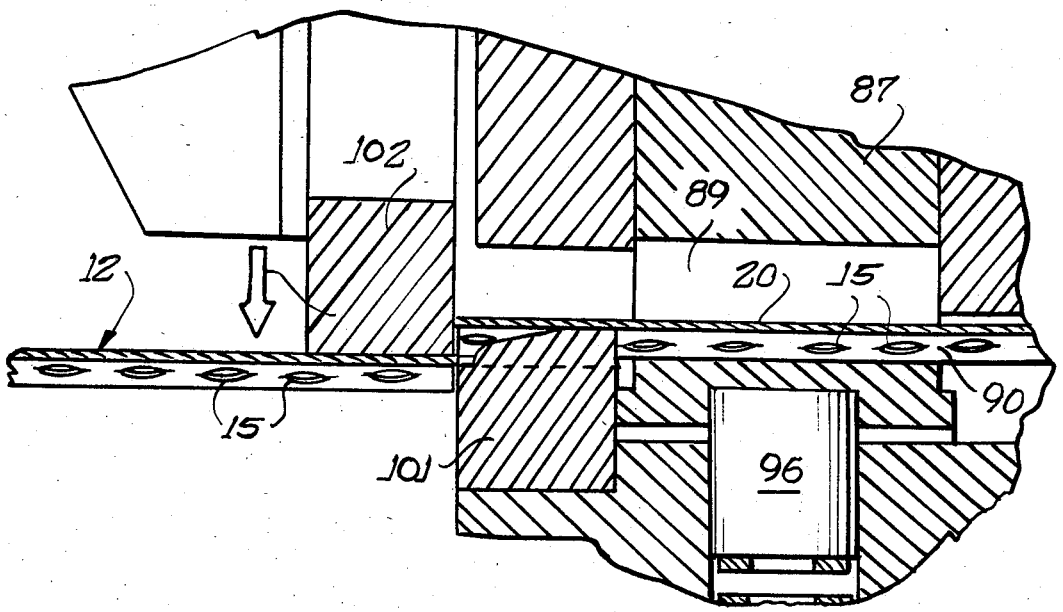
FIG. 11 is a fragmentary cross-sectional view of the die cutoff section.

From the formed strippers 87 and 88, the strip 20 is moved to the left through the shearing station 100 at which is located a lower shear 101 and an upper shear 102 (FIG. 11). In this instance, the lower shear 101 is a fixed bar mounted in the stationary bed **102*a* as best seen in FIG. 11. It is the upward shear 102 which moves its edge 103 downwardly pass adjacent shearing edge 104 of lower shear 101 to shear the sheet 20*a* (FIG. 11) from the continuous strip 20 which extends all the way back to the metal roll 21**.

Figure 12:
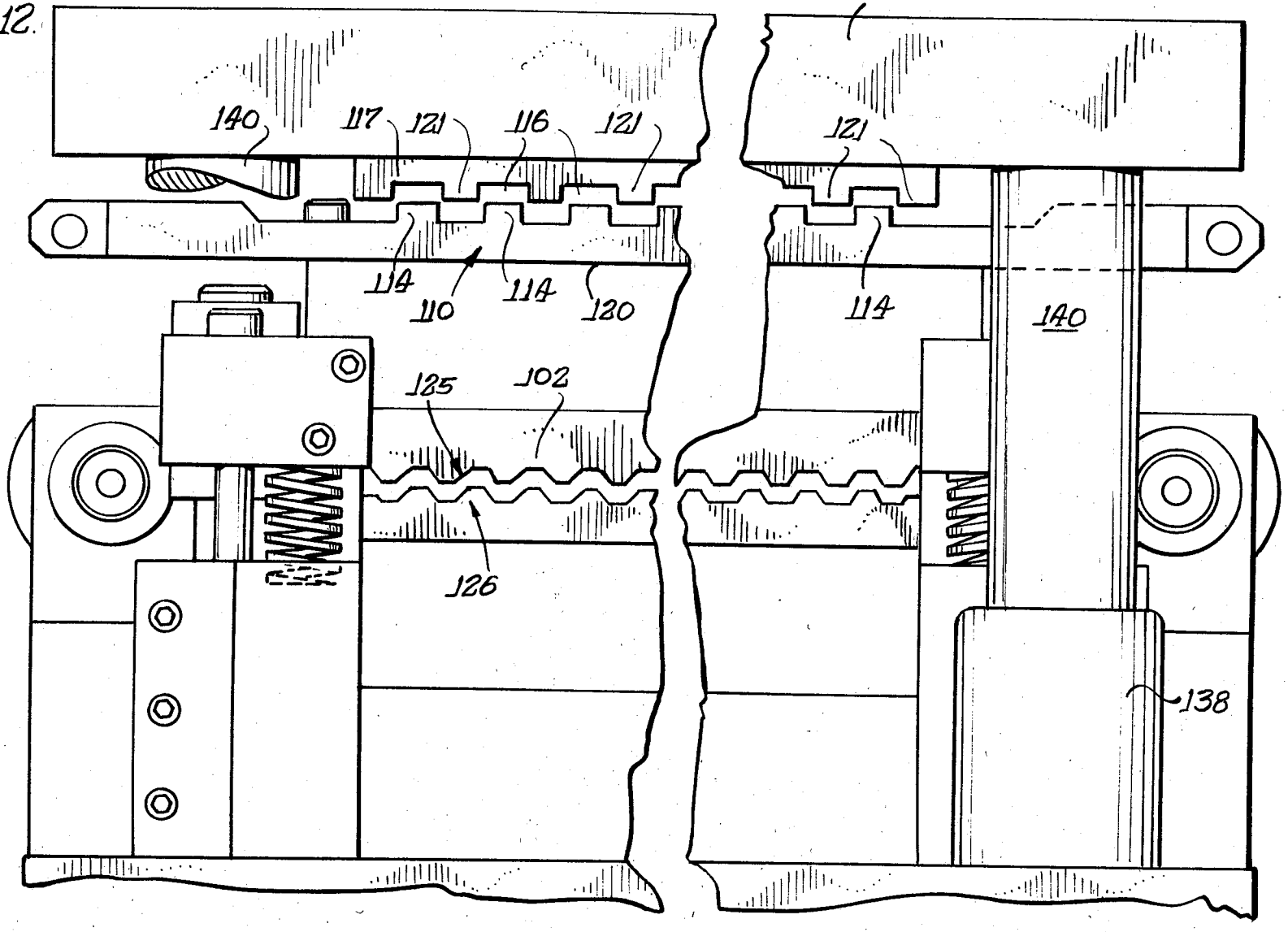
FIG. 12 is an elevational view of the punch press and cutoff section of the die set.

The manner of shearing to the appropriate length is herein done by a counter mechanism which counts the number of strokes of the press. For example, after 120 strokes, a shear actuating means preferably in the form of a shuttle 110 is shifted into position so that the downward stroke of the upper press ram 112 (FIG. 12) forces the upper shear 102 through the cutting stroke position as shown in FIG. 11. More specifically, as best seen in FIG. 12, the shuttle 110 is normally positioned, i.e. between cutting strokes, with upward projections 114 thereon aligned to fit into overhead slots 116 on a lower plate or bar 117 on the ram 112. The shuttle 110 slides in the groove across the upper surface 120 (as best seen in FIG. 12) of the die block. At the appropriate count, the shuttle 110 is pulled to the left, as viewed in FIG. 12, to bring the projections 114 on the shuttle beneath depending projections 121 on the bar 117 so that upon the next actuation of the ram 112 the upper shear bar 102 with its conformed edge 125 as shown in FIG. 12, moves past the conformed edge 126 on the lower shear bar 101 to sever the sheet 20*a* from the strip 20 as shown in FIG. 11.

Figure 13:
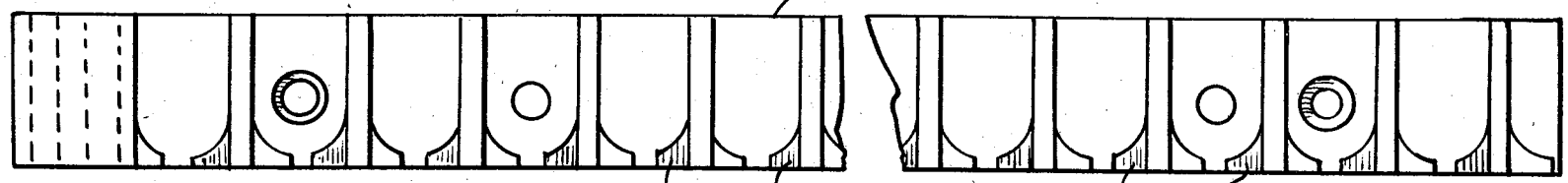
FIG. 13 is a plan view of the cutoff die.
Figure 14:
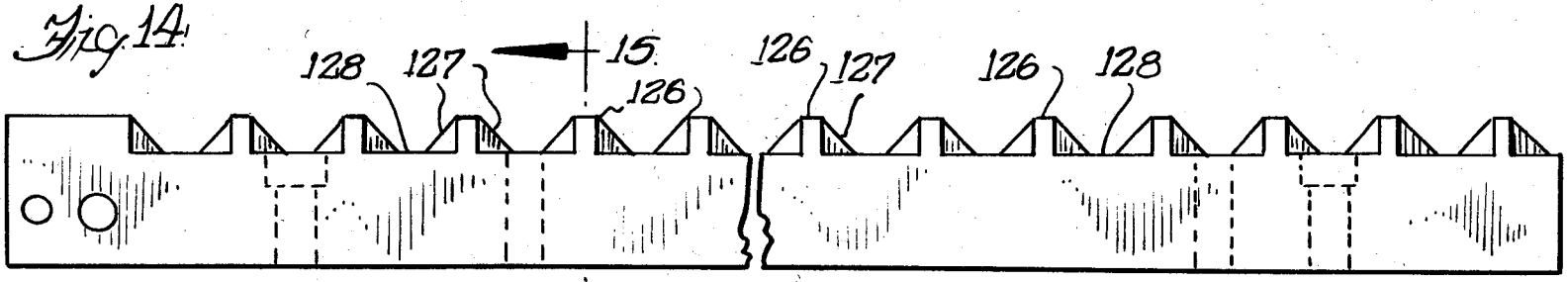
FIG. 14 is an elevational view of the cutoff die.
Figure 15:
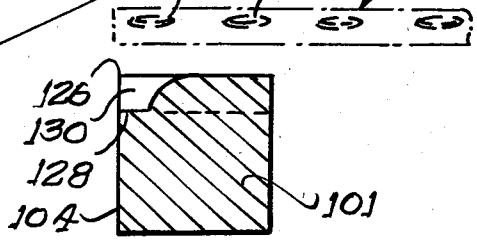
FIG. 15 is a cross-sectional view taken along the line 15—15 of FIG. 14.

The particular cutting bars are shown in greater detail in FIGS. 13, 14 and 15 with the cutting edge 104 being marked in these views. It will be seen that the cutter bar has upwardly extending projecting edges 126 with sloped cutting edges 127 and a bottom cutting edge 128 all fitted precisely within and against the lower side of the corrugated strip 20. The cut is formed between the hooded openings 15. The hoods 70 and 71 for the openings are not flattened during the shearing because of cutout spaces 130, as best seen in FIGS. 11 and 15, in the cutting bars. That is, these hoods on the strip 20 will be located within the cutout areas 130 in the upper and lower shear bars 101 and 102 at the time of severing so that the openings 72 are not closed during the severing action as would be the case except for the cutouts 130.

With the present invention, the timed cutting and closely controlled sheet travel result in the severed edges being continuous and uninterrupted by the openings 15. If one cuts off a sheet across openings 15, the stressed metal at the hoods flares outwardly providing an uneven edge.

Referring now in greater detail to FIG. 6 and the illustrated method and apparatus, the lower die set is stationary with the strip 20 being spaced ⅛ of an inch thereabove so that to the strip it appears that the lower die set actually moves upwardly when in fact the lower die set remains down and fixed to the stationary bolster plate 135 mounted on a base plate 137. Suitable bushings 138 and guide pins 140 on the press guide for recline or movement the overhead ram 102 with a reciprocating motion from the crank shaft, not shown.

In this illustrated embodiment of the invention, the strip 20 is incrementallver the sheet. As the strip is severed into the plate 12, the latter is held and then is dropped downwardly into a stack. As a result, there is a continuous inward movement of a sheet, but at 180 steps per minute the motion has the appearance of being continuous. The severed plates 12 are thus readily stacked and nested one above the other with there being a large number of floor plates in a stack as set forth in the aforementioned patent application.

As an aid to understanding the invention, a brief review of the operation of the illustrated apparatus and method will now be given. From a wound roll of galvanized sheet metal which is approximately 3 feet in width, the leading end of the sheet is fed by feeding means 23 into and through the press 24 having a die set 25 of the progressive type with the strip being moved through the die press and then eventually cut by shearing means including the upper and lower shear dies 101 and 102. The plates 12 are dropped into a stacking mechanism 26 where they are collected. The strip feeding mechanism feeds the strip 20 incrementally and intermittently with a large number of increments per minute with each increment being about ¾ of an inch in length. Herein the plates 12 are severed from the continuous strip after about 120 increments to provide a 7 foot length for the sheet.

The flat metal strip 20 moves through the mouth of the press and between a first set of spring biased stripper pins 42 before moving between an upper slitter bar 31 and a lower slitter bar 32. The lower slitter bar is usually spaced about ⅛ of an inch below the sheet or strip 20 at the time of strip travel. As the upper die set comes downward toward the now stationary strip, the strippers in the upper die block engage the top of the strip 20. Because the upper and lower strippers 42 and 42*a* are equally balanced, the bullet noses 34 on the uper and lower die bars 31 and 32 will engage the strip simultaneously and push through the strip at equal rates from above and below. Thus, to the strip 20, it will appear as though the die bar is moving upwardly when, in fact, it is stationary and the strip is moving down toward the upper surface 39*a* of the lower die block 39. Because the strip 20 is maintained at the pass line and the respective upper and lower slitters 31 and 32 travel through equal distances, the shearing action between the adjacent edges of the respective bars shears a row of slits in the strip. The lower ends of the respective slitter bars 31 and 32 are formed with bullet shaped or rounded noses 34 so as to provide an identical curvature to the respective pieces of metal which are slit and pushed apart.

After being slit, the strip is fed forwardly to the corrugating and hooded opening forming section 50 in which are located the corrugating die bars which have an inclined inlet end 50*a* which slowly and progressively stretches the stiip and progressively deepens the corrugations along the inlet end 50*a*. The strip is bent generally about the respective upwardly projections 54 on the die bars and the lower grooves 58 formed in the lower corrugating die section. The matching upper die set for the corrugation forming section is identical to that shown for the lower section FIGS. 7, 8 and 9 with the metal being pushed into the general position shown in the position FIG. 9. The initial forming from the flat sheet into the corrugated shape takes place along the inclined inlet portion 52 which pushed the metal gently into the corrugated portion with less depth than is finally realized by reaching the ends 52*a* of the corrugated inlet inclined section 52. At the terminal portion of the die section, the corrugated sheet already has its shape but it is beat and coined and bent to make sure it conforms closely to the inclined surfaces 64 which form the slopes and to the projections 54 of the die set which form the apices 61 of the corrugations as well as to closely conform to the bottom wall of the lower die set. During the corrugating, the slits which were previously formed are allowed to open up and to form the hoods 70 and 71 and because recesses 66 are provided along each of the sloped side walls 64 of the corrugating dies the metal above the slits is free to reform as it is stretched along the corrugating dies. As previously described in connection with FIGS. 4 and 6, the metal when flat has a predetermined length L and this metal is bent and stretched about the corrugated dies so that it has a much longer length because of the upper and downward bends having been imparted to form the corrugations which in this instance are approximately ¼ inch in height and about ¾ of an inch in width between adjacent corrugations. The area 80 is bent and is allowed to rework with upper hoods 70 taking a curve configuration to generally overlie the opening 15 and with the lower hood 71 also taking an opposite curve position to project inwardly. The particular formation of the hoods as seen in FIG. 6 allows for the transfer of metal of fibers upwardly towards the apex 61 or to the bottom 62 with result that metal and material is shifted to assist in a beam or deformation load carrying capability for the floor plate. The respective openings 15 are located along the neutral axis or pass line 33 where minimal strength is needed to support a beam load. In the illustrated embodiment of the invention, the initial width of the sheet is 36 inches and the final finished width of the corrugated stripper is about 35¾ inch. Only the outer marginal longitudinal edges of the sheet are bent to reduce the strip width. The interior corrugations are all a result of drawing the metal.

As above explained, because of the repeated forming of the corrugations in the stretching of the metal there is actual grain deformation and cold working which results in a substantial improvement in the strength capabilities of the floor plate. For example, the tensile strength increase from about 45,000 to 55,000 psi when having undergone the corrugating and slitting operations defined above.

At the cut off section of the progressive die the shuttle 110 is positioned after an appropriate feed of the strip 20 into a location with its projections 114 aligned with the projections 121 on a bar 117 fixed to the reciprocating power ram 112. As the latter drives downwardly the upper severing bar 102 moves past the stationary severing bar 101 to sever a corrugated plate 12 from the strip.

From the foregoing, it will be seen that corrugated plates may be formed into finished aerated and corrugated grain bin floor plates in a simple and economical manner as is needed to compete commercially against grain bin floor plates prepared in accordance with prior art methods. Not only are the plates finished in the stamping operation but the metal is also cold worked and hardened to give increased strength to the floor plates. The process and apparatus will form very large width sheets, for example, 3 feet or greater in width from a strip of metal.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A method of making corrugated grain bin floor plates having aeration slots therein in a progressive die in a punch press, said method comprising the steps of:

feeding a longitudinally extending strip of metal through a progressive die set in a die press;

slitting the strip at a plurality of locations in a first portion of the progressive die in a direction parallel to the longitudinal direction;

feeding the slitted section of the strip forwardly to a second portion of the progressive die; and forming corrugations in the strip with the corrugations running parallel and longitudinally of the strip and in the elongated direction of the slits and stretching the metal while corrugating the strip to open the slits to increase the width of the slits to form the aeration slots and severing the corrugated and slotted strip to form a floor plate.

2. A method in accordance with claim 1 in which the steps of slitting the strip comprises shearing the metal and forcing metal downwardly and upwardly to form curved upper and lower portions to be reformed into curved hoods for the slots.

3. A method in accordance with claim 1 including the steps of equally biasing the strip from above and below in the die set with equal forces to maintain the strip at a pass line spaced above an upper surface of a lower die section of the die set during the working station.

4. A method in accordance with claim 1 including the step of holding the strip against transverse movement in the die by contoured strippers at the outlet end of the die set.

5. An apparatus for making corrugated grain bin floor plates having aeration slots therein, said apparatus comprising:

a punch press, having a progressive die set;

means for feeding a longitudinally extending strip of metal through a progressive die set in a die press;

means for slitting the strip at a plurality of locations in a first portion of the progressive die in a direction parallel to the longitudinal direction;

means for feeding the slitted section of the trip forwardly to a second portion of the progressive die; and means for forming corrugations in the strip extending longitudinally of the strip with the corrugations running parallel with the elongated direction of the slits and stretching the metal while corrugating the strip to open the slits to increase the width of the slits to form the aeration slots, and means for severing the corrugated and slotted strip to form a floor plate.

6. An apparatus in accordance with claim 5 in which the means for slitting the strip comprises means for shearing the metal and forcing metal downwardly and upwardly to form curved upper and lower portions to be reformed into curved hoods for the slots.

7. An apparatus in accordance with claim 5 including means for biasing the strip from above and below with equally opposed forces to maintain the strip at a pass line spaced above an upper surface of a lower die section of the die set.

8. An apparatus in accordance with claim 5 in which the feeding means feeds the strip intermittently through the die set, said die set progressively forming the corrugations over a series of consecutive die closing operations and drawing the metal progressively over the corrugating dies.

9. An apparatus in accordance with claim 5 including means for holding the strip against transverse movement in the die including contoured strippers at the outlet end of the die set.

10. A method of making corrugated grain bin floor plates having aeration slots therein in a progressive die in a punch press, said method comprising the steps of:

feeding a longitudinally extending strip of metal through a progressive die set in a die press;

holding the strip from above and below by spring biased strippers at a location above the lower die set, slitting the strip at a plurality of locations in a first portion of the progressive die in a direction parallel to the longitudinal direction;

feeding the slitted section of the strip forwardly to a second portion of the progressive die; and progressively forming corrugations in the strip in the longitudinal direction of the strip with the corrugations running parallel with the elongated direction of the slits, stretching the metal while corrugating the strip to open the slits to increase the width of the slits to form the aeration slots and, coining the metal in the strip to take the shape of the dies, and severing the corrugated and slotted strip to form a floor plate.

11. A method of slitting a strip in a punch press having an upper slitter bar and a lower slitter bar and upper and lower sets of strippers, said method comprising the steps of:

holding the strip with the lower strippers above the lower slitter bars, engaging the upper surface of the strip with the upper set of strippers, balancing the upper and lower strippers to impart substantially equal forces to the upper and lower sides of the sheet, abutting the upper stripper bar against the upper side of the strip and pushing the strip to lower it to abut the upper ends of the lower strip bar, slitting the strip simultaneously in equal distances by the upper and lower slitter bars while the strip remains floating on the lower set of strippers above the upper surface of the lower die set, and raising the upper die set to allow the lower strippers to lift the strip above the lower die bar, and feeding the strip when stripped from the lower and upper die bars.

* * * * *